US007007389B1

(12) United States Patent
Arif

(10) Patent No.: US 7,007,389 B1
(45) Date of Patent: Mar. 7, 2006

(54) LOTION DISPENSING SHAVING APPARATUS

(76) Inventor: Mohammad Arif, 929 Marlyn Garden Dr. #2 A, Baltimore, MD (US) 21221

( * ) Notice: Subject to any disclaimer, the term of this patent is extended or adjusted under 35 U.S.C. 154(b) by 111 days.

(21) Appl. No.: 10/764,361

(22) Filed: Jan. 23, 2004

(51) Int. Cl.
*B26B 19/38* (2006.01)

(52) U.S. Cl. ..... 30/41; 206/228; 604/309

(58) Field of Classification Search ..... 30/41, 30/41.5; 604/310, 308, 309; 206/228
See application file for complete search history.

(56) References Cited

U.S. PATENT DOCUMENTS 2,632,446 A * 3/1953 Rosenzweig ..... 604/310
3,985,146 A 10/1976 Albach
4,635,361 A 1/1987 De Mars
4,753,006 A * 6/1988 Howe ..... 30/41
4,760,642 A 8/1988 Kwak
4,994,068 A * 2/1991 Hufnagle ..... 606/181
5,287,624 A * 2/1994 Mondo et al. ..... 30/41
5,337,478 A 8/1994 Cohen et al.

* cited by examiner

*Primary Examiner*—Allan N. Shoap
*Assistant Examiner*—Edward Landrum

(57) ABSTRACT

A lotion dispensing shaving apparatus for shaving and dispensing shaving cream and after shave lotion includes a razor having a handle portion including a pair of lengthwise compartments. A pair of sliding levers are operationally coupled to the compartments for selectively dispensing contents of the compartments from sides of the handle adjacent to a bottom of the handle. The razor head has two angled sides each having dual blades. In various embodiments the razor head includes grooved rollers and the handle portion includes a compartment on the bottom of the handle portion for holding an antiseptic impregnated pad.

8 Claims, 4 Drawing Sheets

LOTION DISPENSING SHAVING APPARATUS

FIELD OF THE INVENTION

The present invention relates to shaving devices and more particularly pertains to a new lotion dispensing shaving apparatus for providing a self-contained apparatus for shaving and dispensing shaving cream and after shave lotion.

DESCRIPTION OF THE PRIOR ART

The use of shaving devices is known in the prior art. U.S. Pat. No. 3,985,146 describes a disposable one time use razor and shaving cream dispenser having a head portion and a flexible outer jacket holding shaving cream around a stiffening member forming a handle for the razor. Another type of shaving device is U.S. Pat. No. 4,635,361 having a razor and shaving cream dispenser that dispensing shaving cream through a bottom of the handle of the razor. U.S. Pat. No. 4,760,642 discloses a razor and toothbrush assembly having a shaving cream dispenser for delivering shaving cream to the razor head. U.S. Pat. No. 5,337,478 discloses an automatic shaving apparatus having pressurized foam and lotion dispensers to deliver foam and/or lotion directly to the area being shaved as it is being shaved.

While these devices fulfill their respective, particular objectives and requirements, the need remains for a self-contained razor that provides superior function as a razor while also providing dispensing of cream, lotion, and antiseptic.

SUMMARY OF THE INVENTION

The present invention generally comprises a razor having a handle portion including a pair of lengthwise compartments. A pair of sliding levers are operationally coupled to the compartments for selectively dispensing contents of the compartments from sides of the handle adjacent to a bottom of the handle. The razor head has two angled sides each having dual blades. In various embodiments the razor head includes grooved rollers and the handle portion includes a compartment on the bottom of the handle portion for holding an antiseptic impregnated pad.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
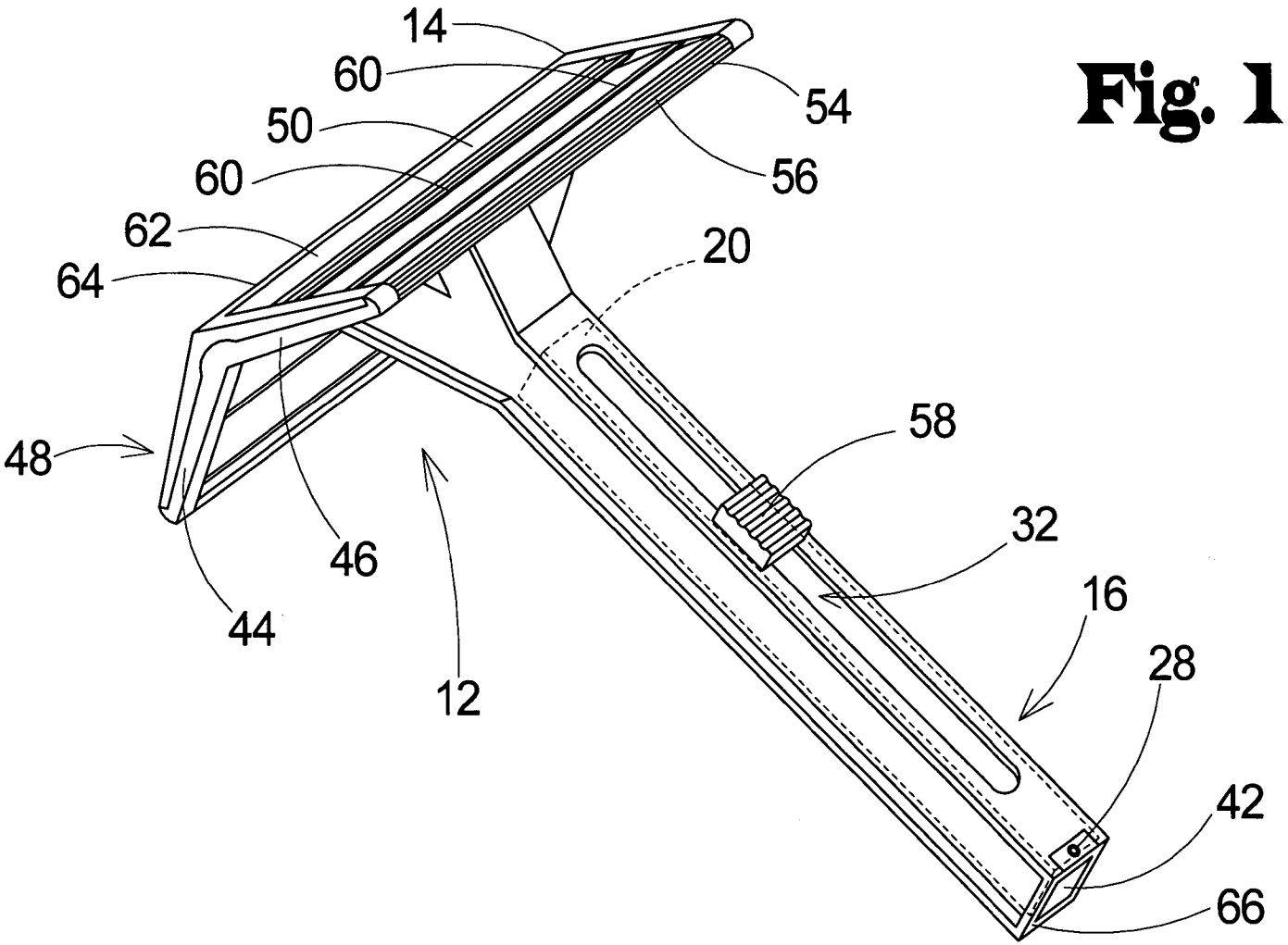
FIG. 1 is a perspective front view of a new lotion dispensing shaving apparatus according to the present invention.
Figure 2:
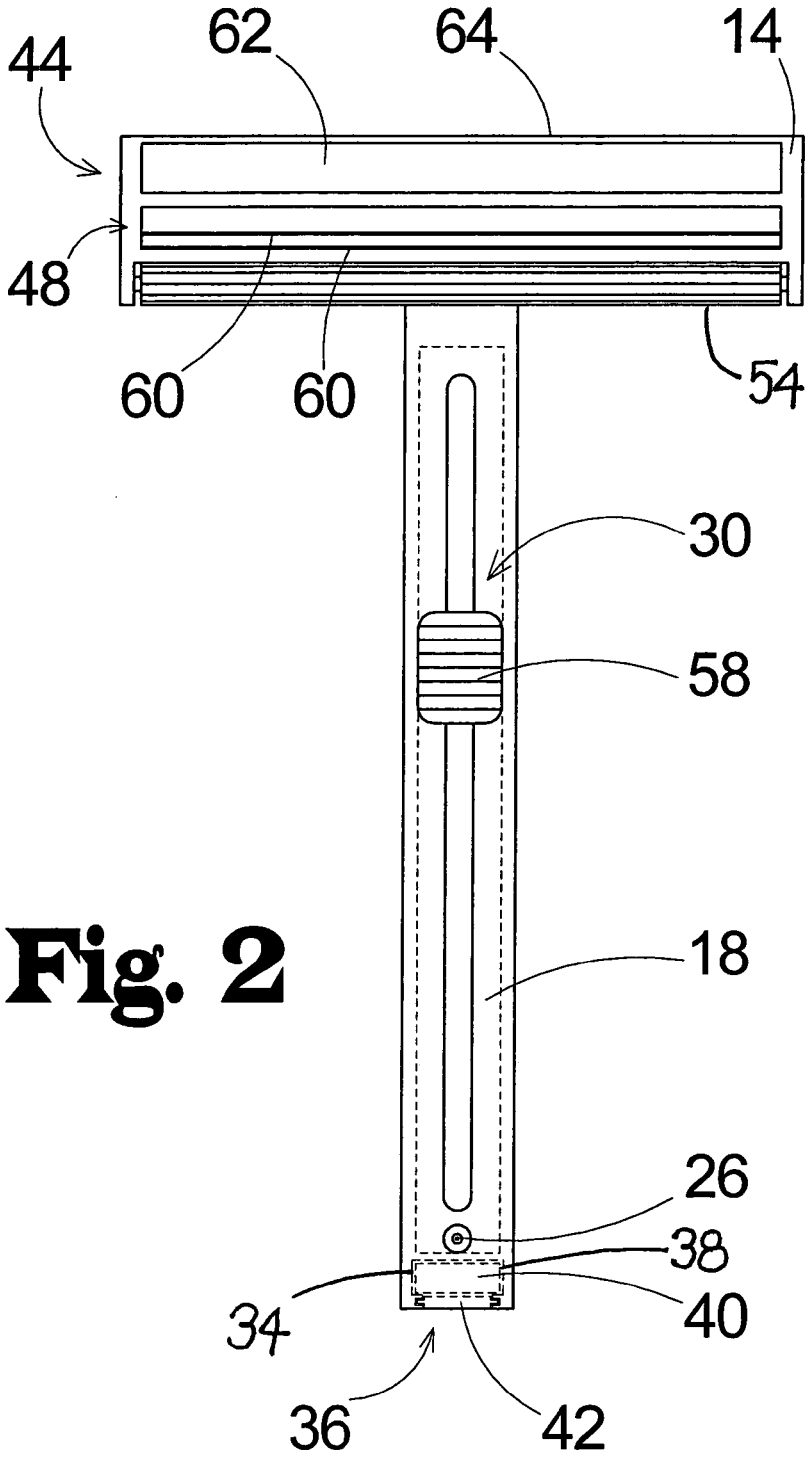
FIG. 2 is a rear view of the present invention.
Figure 3:
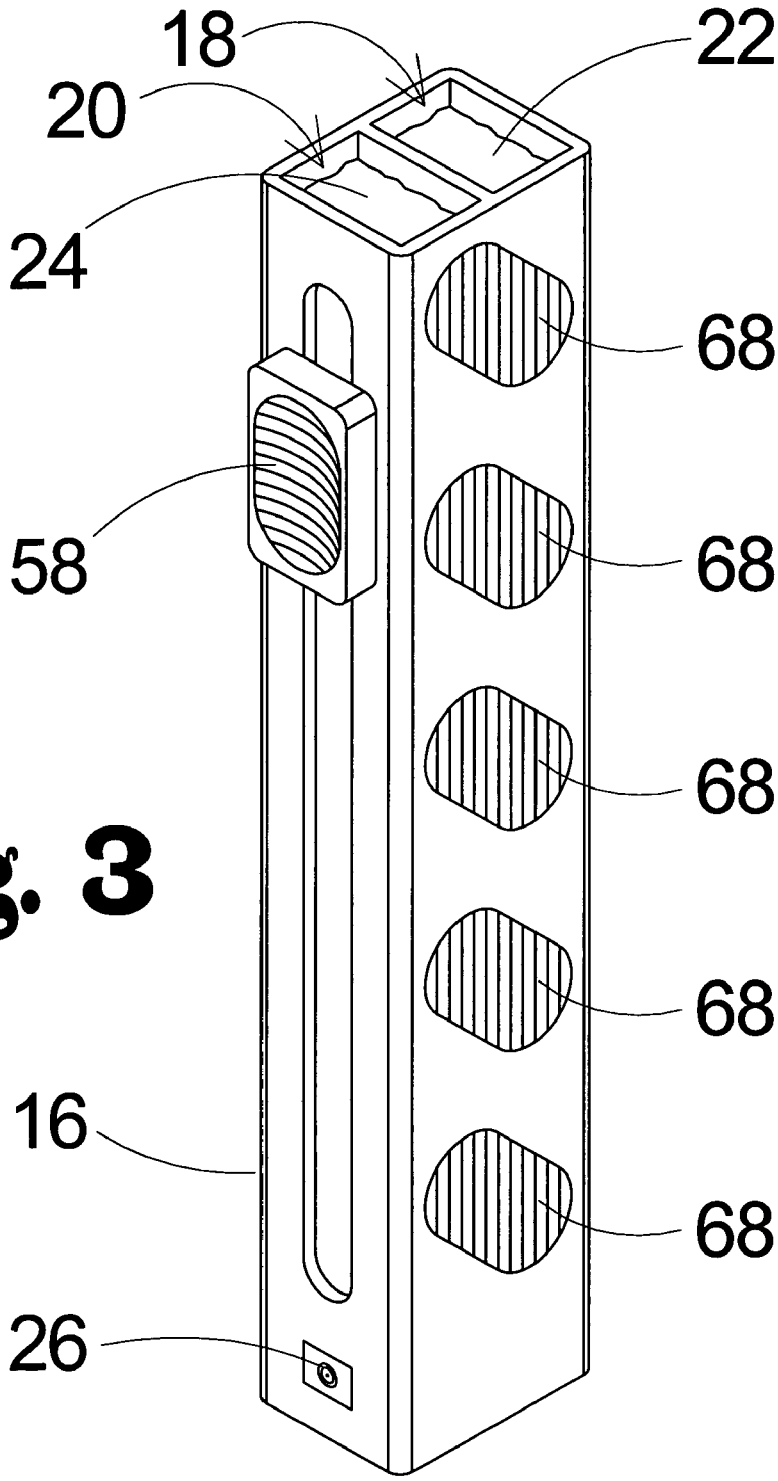
FIG. 3 is a perspective side view of the handle portion of the present invention.
Figure 4:
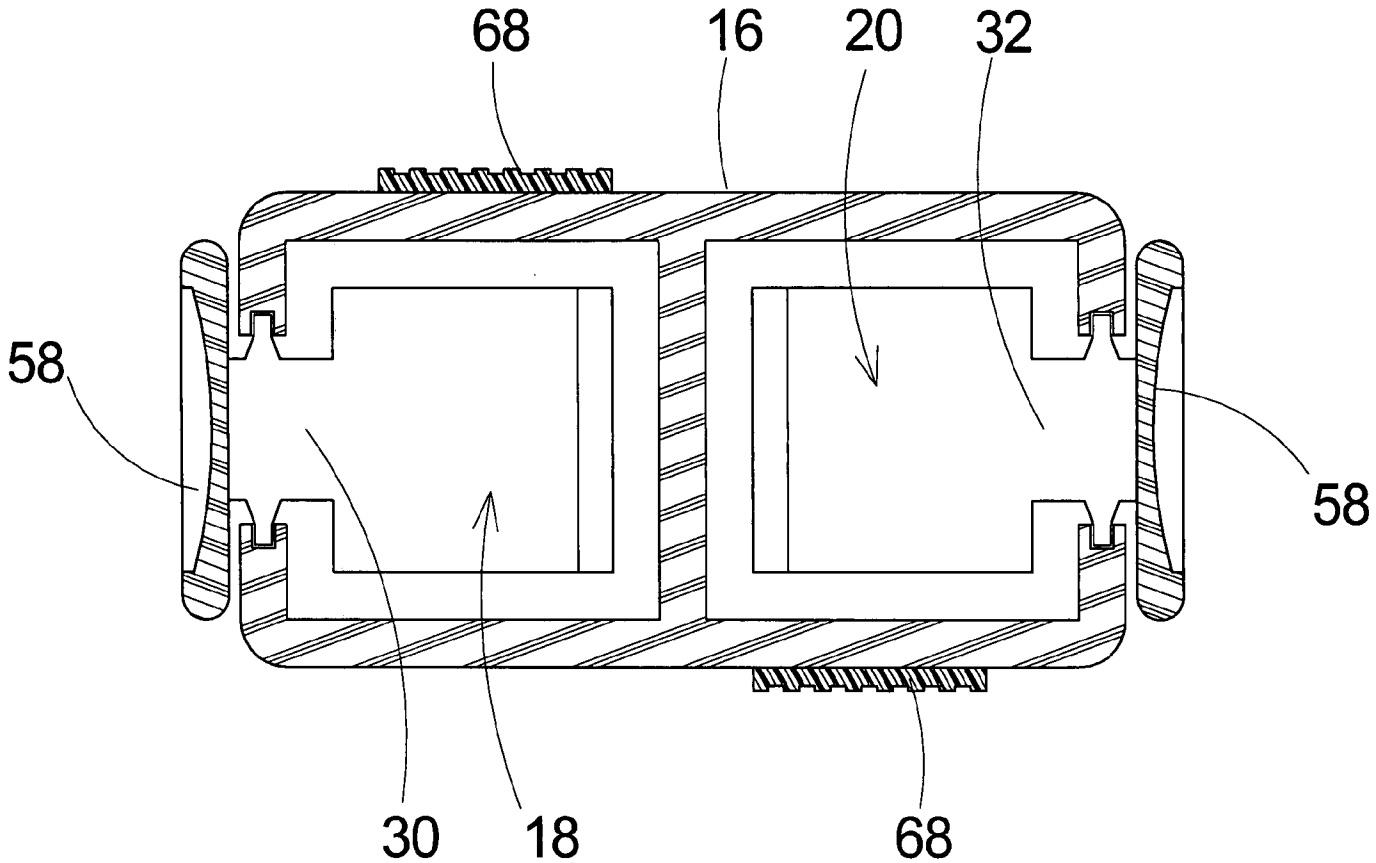
FIG. 4 is a cross-sectional top view of the handle portion of the present invention.

With reference now to the drawings, and in particular to FIGS. 1 through 4 thereof, a new lotion dispensing shaving apparatus embodying the principles and concepts of the present invention and generally designated by the reference numeral 10 will be described.

As best illustrated in FIGS. 1 through 4, the lotion dispensing shaving apparatus 10 generally comprises a razor 12 having a head portion 14 and a handle portion 16. The handle portion 16 is structured to include a pair of elongated compartments 18,20. Thus, the handle portion 16 is designed for holding a pair of shaving substances 22,24 such as a shaving cream applied before shaving and an after-shave lotion applied after shaving.

A pair of one way dispensing valves 26,28 are positioned on the handle portion 16. Each one way dispensing valve 26,28 is in environmental communication with a respective one of the elongated compartments 18,20. Each dispensing valve 26,28 is preferably positioned on a respective side of the handle portion 16 adjacent to an end 66 of the handle portion 16.

A pair of lever assemblies 30,32 are operationally coupled to a respective one of the elongated compartments 18,20 such that the shaving solution 22 or 24 within each elongated compartment 18,20 is selectively dispensable by manipulating an associated one of the lever assemblies 30,32.

A base compartment 34 is included. The base compartment 34 has an opening 36 exposing an interior 38 of the base compartment 34. The base compartment 34 is positioned on the end 66 of the handle portion 16 opposite the head portion 14.

An antiseptic impregnated pad 40 is positioned in the base compartment 34. The positioning of the base compartment 34 opposite the head portion 14 prevents accidental nicking or cutting while using the antiseptic impregnated pad 40.

A cover 42 is coupled to the handle portion 16 for selectively covering the base compartment 34. Covering the base compartment 34 prevents the antiseptic impregnated pad 40 from prematurely drying out and prevents unintended application of antiseptic while shaving. The cover 42 is a sliding cover for sliding between an open position and a closed position.

In an embodiment, the head portion 14 forms a pair of angled sides 44,46 extending from the handle portion 16. A pair of blade assemblies 48,50 are provided and each blade assembly 48,50 is positioned on a respective one of the angled sides 44,46. Each blade assembly 48, 50 preferably includes a pair of spaced blades 60.

A pair of elongated rollers 52,54 are provided. Each elongated roller 52,54 is coupled to a respective one of the angled sides 44,46 adjacent to an associated one of the blade assemblies 48,50 such that each elongated roller 52,54 passes over a surface 2 to be razed before the associated blade assembly 48,50 passes over the surface. To assist in smooth application of the shaving cream over the surface 2, each elongated roller 52,54 includes a plurality of lengthwise grooves 56.

In an embodiment, each of the lever assemblies 30,32 are each a sliding lever assembly 58.

The handle may also include angled gripping pads 68 extending in spaced relationship along a length of the handle portion 16.

Each blade assembly 48,50 may also include a flat area 62 positioned between the respective blade assembly 48,50 and a crest 64 of the head portion 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lotion dispensing shaving apparatus comprising:

a razor having a head portion and a handle portion;

said handle portion being structured to include a pair of elongated compartments whereby said handle portion is adapted for holding a pair of shaving substances;

a pair of one way dispensing valves positioned on said handle portion, each one way dispensing valve being in environmental communication with a respective one of said elongated compartments;

a pair of lever assemblies, each lever assembly being operationally coupled to a respective one of said elongated compartments such that the shaving solution within each elongated compartment is selectively dispensable by manipulating an associated one of said lever assemblies;

a base compartment having an opening exposing an interior of said base compartment, said base compartment being positioned on an end of said handle portion opposite said head portion;

an antiseptic impregnated pad positioned in said base compartment; and a cover coupled to said handle portion for selectively covering said base compartment.

2. The lotion dispensing shaving apparatus of claim 1, further comprising:

said head portion forming a pair of angled sides extending from said handle portion; and a pair of blade assemblies, each blade assembly being positioned on a respective one of said angled sides.

3. The lotion dispensing shaving apparatus of claim 1, further comprising:

a blade assembly coupled to said head portion;

an elongated roller coupled to said head portion adjacent to said blade assembly such that said elongated roller passes over a surface being razed before said blade assembly.

4. The lotion dispensing shaving apparatus of claim 3 wherein said elongated roller includes a plurality of lengthwise grooves.

5. The lotion dispensing shaving apparatus of claim 1, further comprising:

a pair of elongated rollers, each elongated roller being coupled to a respective one of said angled sides adjacent to an associated one of said blade assemblies such that each said elongated roller passes over a surface being razed before said associated blade assembly.

6. The lotion dispensing shaving apparatus of claim 1 wherein said lever assemblies are each a sliding lever assembly.

7. The lotion dispensing shaving apparatus of claim 1 wherein said cover is a sliding cover for sliding between an open position and a closed position.

8. The lotion dispensing shaving apparatus of claim 3 wherein said blade assembly includes two spaced blades.

* * * * *